United States Patent [19]

Wakatsuki

[11] Patent Number: 4,600,149

[45] Date of Patent: Jul. 15, 1986

[54] APPARATUS FOR PRODUCING ULTRAHIGH PRESSURE WATER JET

[75] Inventor: Masakatsu Wakatsuki, Ota, Japan

[73] Assignee: Wakatsuki Kikai Kabushiki Kaisha, Gunma, Japan

[21] Appl. No.: 701,331

[22] Filed: Feb. 13, 1985

Related U.S. Application Data

[62] Division of Ser. No. 542,810, Oct. 17, 1983, Pat. No. 4,534,711.

[30] Foreign Application Priority Data

Jul. 1, 1983 [JP] Japan ..... 58-103124[U]
Aug. 8, 1983 [JP] Japan ..... 58-123085[U]

[51] Int. Cl.[4] ..... B05B 1/28; B05B 3/00; B05B 1/34; B05B 1/14

[52] U.S. Cl. ..... 239/120; 239/264; 239/380; 239/553

[58] Field of Search ..... 239/102, 104, 120, 121, 239/225, 264, 380, 553; 51/439

[56] References Cited

U.S. PATENT DOCUMENTS 3,148,832 9/1964 Point ..... 239/224 X
3,667,676 6/1972 Watanabe et al. ..... 239/700
4,045,915 9/1977 Gilbert et al. ..... 51/439 X
4,341,350 7/1982 Wemmer ..... 239/419 X
4,369,850 1/1983 Barker ..... 239/102 X

FOREIGN PATENT DOCUMENTS 56-45334 4/1981 Japan ..... 239/380
584898 8/1976 U.S.S.R. ..... 239/120

*Primary Examiner*—Joseph F. Peters, Jr.
*Assistant Examiner*—Patrick N. Burkhart
*Attorney, Agent, or Firm*—Pollock, VandeSande and Priddy

[57] ABSTRACT

An ultrahigh pressure water apparatus converts feed water of normal pressure into ultrahigh pressure water by means of an ultrahigh pressure pump and projects the ultrahigh pressure water through a nozzle gun in the form of jets of ultrahigh pressure water. The nozzle gun has an eccentric shaft tube rotatably disposed inside a nozzle cover, a high pressure hose rotatably inserted into the eccentric shaft tube, and nozzles fastened to the leading end of the high pressure hose. Owing to the rotation of the eccentric shaft tube, the jets of ultrahigh pressure water projected through the nozzle are sympathetically rotated.

4 Claims, 13 Drawing Figures

APPARATUS FOR PRODUCING ULTRAHIGH PRESSURE WATER JET

This is a division of application Ser. No. 542,810 filed Oct. 17, 1983 now U.S. Pat. No. 4,534,711.

BACKGROUND OF THE INVENTION

This invention relates to an apparatus for producing an ultrahigh pressure water jet capable of projecting a jet of ultrahigh pressure water through a nozzle gun against a given object for the purpose of cleaning the surface of the object, peeling a coating off the surface, or removing rust from the surface.

The conventional ultrahigh pressure water apparatus has been designed so that a plurality of jets of water at ultrahigh pressure of 2,000 kg/cm$^2$, may be projected through a nozzle gun thereof and, by suitable movement of the nozzle gun enables the jets to dash against a given object uniformly throughout the entire surface thereof. For the entire surface of the object to be uniformly cleaned or stripped of the coating, therefore, the nozzle gun has been required to be moved delicately. Since the delicacy with which the movement of the nozzle gun is controlled has its own limit, it has been inevitable that the individual jets of water projected through the nozzle gun should be given a large diameter. Consequently, the volume of water discharged through each nozzle, a pump used for generating the ultrahigh pressure water, and a motor or generator engine used for driving the pump have invariably been proportionately large, with the inevitable result that the apparatus as a whole has become quite expensive. Further owing to the large diameter of the projected water jets, the total volume of water discharged through the nozzle gun per unit time has been large and the nozzle gun has been so large and heavy as to render its manual operation difficult and dangerous. Thus, the nozzle gun has been adapted to be operated as mounted on a stationary support. As a natural consequence, the operation of the nozzle gun for the cleaning or stripping of the surface of the object has suffered from inferior efficiency. With the conventional ultrahigh pressure water apparatus, therefore, it has been difficult to perform works which demand meticulous care such as, for example, the cleaning of deep corners of a tank interior.

SUMMARY OF THE INVENTION

An object of this invention is to provide an ultrahigh pressure water apparatus so constructed that the nozzle gun thereof can be easily operated by hand with high efficiency and without any danger.

Another object of this invention is to provide an ultrahigh pressure water apparatus incorporating therein a pump capable of producing ultrahigh pressure water with minimal friction in the piston ring and the packing.

Yet another object of this invention is to provide an ultrahigh pressure water apparatus capable of collecting spent water without jeopardizing the environment of its operation.

This invention is directed to an ultrahigh pressure water apparatus of the type operated on the principle that an ultrahigh pressure pump driven by a pump driving source such as motor receives water of normal pressure, converts it into ultrahigh pressure water, delivers the ultrahigh pressure water to a nozzle gun, and projects it through the nozzle gun in the form of an ultrahigh pressure water jet. In the ultrahigh pressure water apparatus of this type which is specifically contemplated by this invention, the nozzle gun has an eccentric tube rotatably supported substantially coaxially within a nozzle cover, with the center of the inner wall of this eccentric tube deviating from the center of the nozzle cover, and a high pressure hose is rotatably inserted into the eccentric tube. A drive shaft is disposed near and along the nozzle cover and rotatably supported by the nozzle cover, so that the rotation of the drive shaft may cause the eccentric tube to operate. The high pressure hose is provided at the leading end thereof with a nozzle. Ultrahigh pressure water is introduced into the high pressure hose through the other end thereof and is projected through the nozzle. Owing to the rotation of the eccentric tube, the center of the high pressure hose is rotated relative to the center of the nozzle cover and, consequently, the jet of ultrahigh pressure water projected through the nozzle is rotated sympathetically. Even when the nozzle gun is kept fixed, therefore, the jet of water dashes against a given object not at one fixed point but along a circle. Even when the beam of water has a small diameter, the nozzle is capable of dashing the jet of water uniformly against the surface of the object.

The ultrahigh pressure pump is of a plunger type having a piston airtightly diposed inside a cylinder reciprocally along the axis of this cylinder. In the inner end surface of this piston, a piston hole is formed at the axial position. Inside this piston hole, a free piston is disposed which is freely movable along the axis thereof. Outside this piston hole, an annular recess intended as an oil reservoir is formed on the peripheral surface of the piston. This oil collecting recess and the interior of the piston hole communicate with each other and they are filled with lubricating oil. O-rings are interposed between the peripheral surface of the piston and the cylinder at a position inward from the oil-collecting recess. Also between the peripheral surface of the free piston and the inner wall of the piston hole, there is interposed an O-ring. A water feed pipe communicates with the inner end portion of the cylinder and a discharge pipe for releasing the ultrahigh pressure water also communicates therewith. Owing to the ultrahigh pressure pump constructed as described above, the lubricating oil can be brought into contact with a large portion of the area of the inner wall of the cylinder, with the result that the O-rings and the piston rings are rendered minimally susceptible to injuries. Since the free piston is small enough to be quickly moved in response to change in the water pressure inside the cylinder and enabled to maintain pressure balance harmoniously between water and the lubricating oil, the seal by the O-rings can be retained safely.

A collector is disposed to enclose the nozzle cover. The collector has its opening in the direction in which the nozzle projects the jet of water. The portion of the water rebounded by the surface of the object enters the interior of the collector. A suction hose communicates with the interior of the collector. Through this suction hose, the interior of the collector is kept evacuated with a vacuum pump. The rebounded water which has entered the interior of the collector, therefore, is withdrawn through the suction hose. The possibility of the environment of the operation of the generator being defiled by the rebounded water is eliminated.

DETAILED DESCRIPTION OF PREFERRED EMBODIMENT

Figure 1:
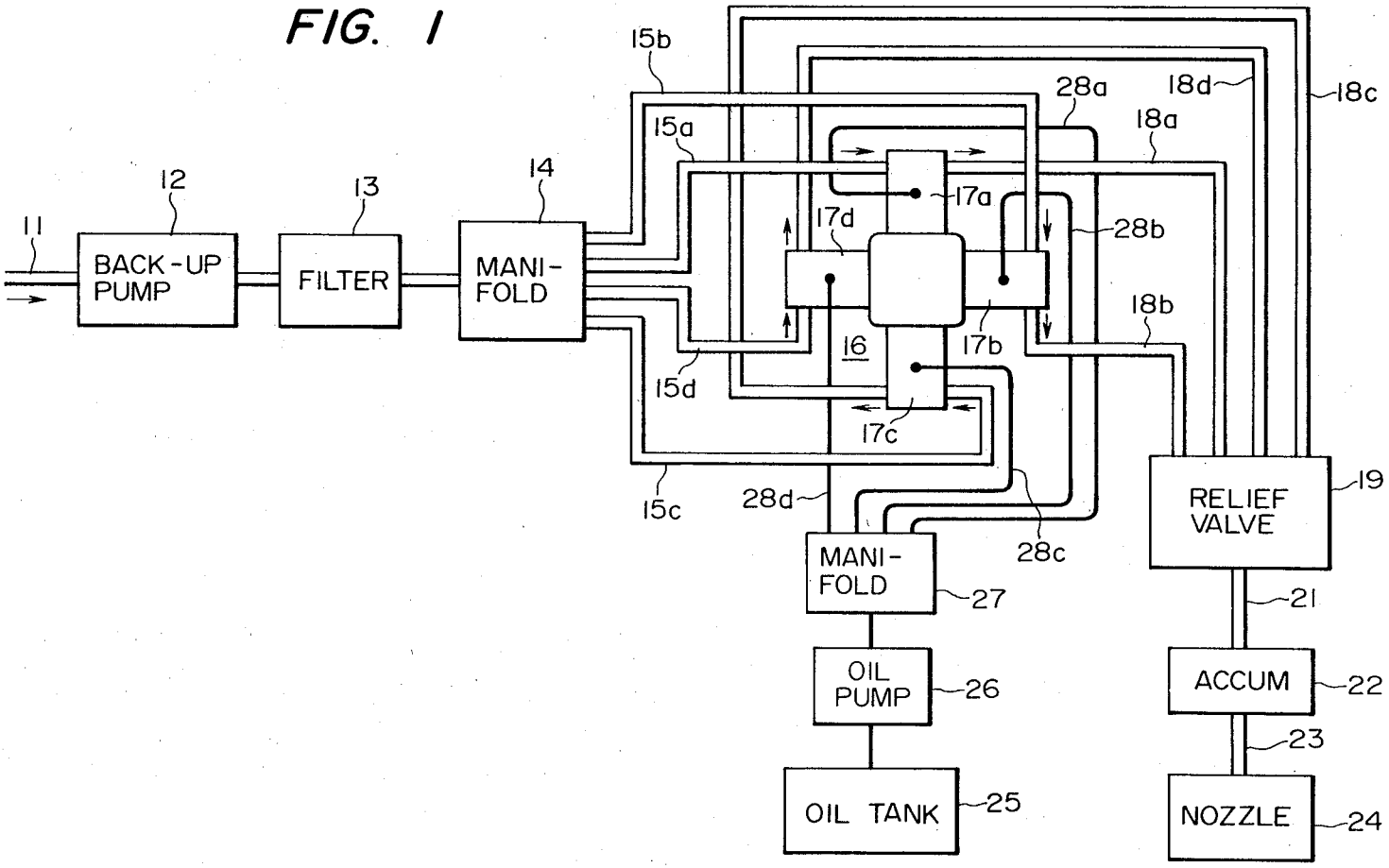
FIG. 1 is a block diagram illustrating a piping system used in a typical ultrahigh pressure water apparatus according to the present invention.

FIG. 1 illustrates, in outline, a piping system to be laid out in a typical ultrahigh pressure water apparatus according to the present invention. The water introduced through a water inlet pipe 11 has its pressure increased by a backup pump 12 and then is forwarded to a filter 13. The water is freed of foreign particles by the filter 13 and then forwarded to a manifold pipe 14. At the manifold pipe 14, the water is divided into four streams through feed water pipes 15*a*–15*d* and forwarded to an ultrahigh pressure pump 16. This ultrahigh pressure pump 16 is a plunger type four-pole pump. Into four pump sections 17*a*–17*d* of this pump 16, the streams of water through the feed water pipes 15*a*–15*d* are supplied. The streams of water which have their pressure increased to ultrahigh pressure inside the pump are sent through discharge pipes 18*a*–18*d* to a pressure regulating valve, i.e. a relief valve 19. The streams of water have their ultrahigh pressure adjusted by the relief valve 19 to a desired level. They are forwarded through a pipe 21 to an accumulator 22. The accumulator 22 converts the streams of water sequentially and repeatedly brought in through the four pump sections 17*a*–17*d* into a substantially continuous stream of ultrahigh pressure water and forwards this continuous stream of water to a high pressure hose 23, which communicates with a nozzle gun 24. Through this nozzle gun 24, the ultrahigh pressure water is projected in the form of a jet of ultrahigh pressure water. The lubricating oil inside an oil tank 25 has its pressure increased by a pressurizing pump 26 and is forwarded to a manifold 27. The manifold 27 supplies the lubricating oil through oil feed pipes 28*a*–28*d* respectively to the pump sections 17*a*–17*d*.

Figure 2:
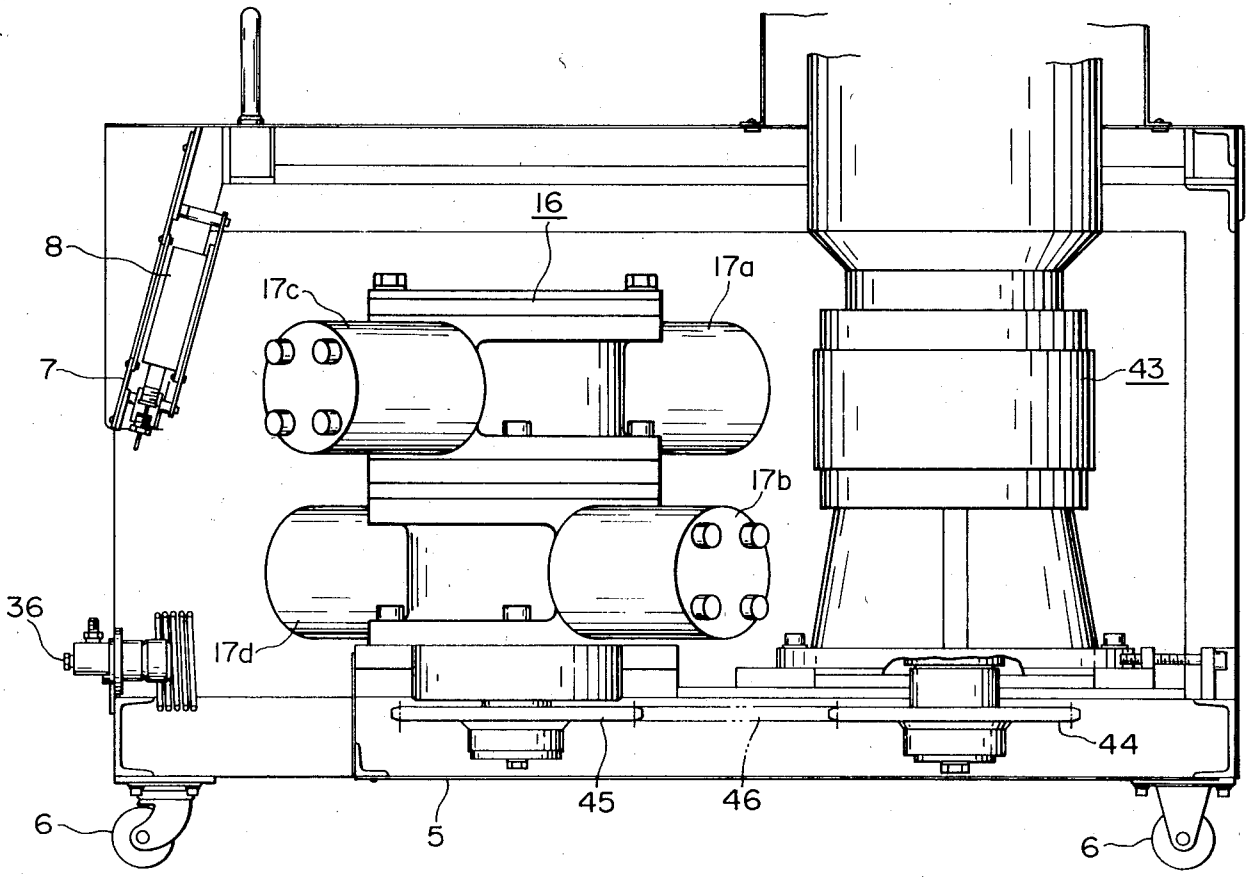
FIG. 2 is a side view of the typical ultrahigh pressure water apparatus of this invention, with the cover removed to expose the interior.
Figure 3:
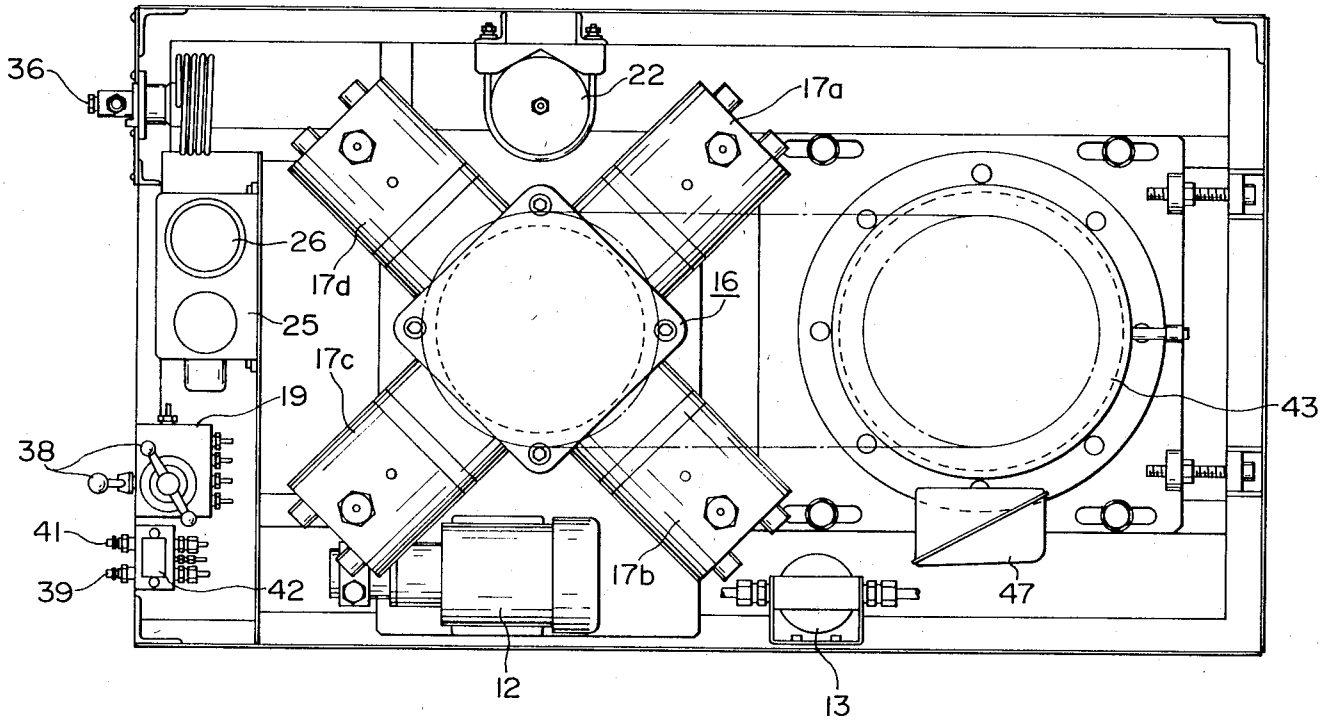
FIG. 3 is a plan view of the apparatus of FIG. 2.
Figure 4:
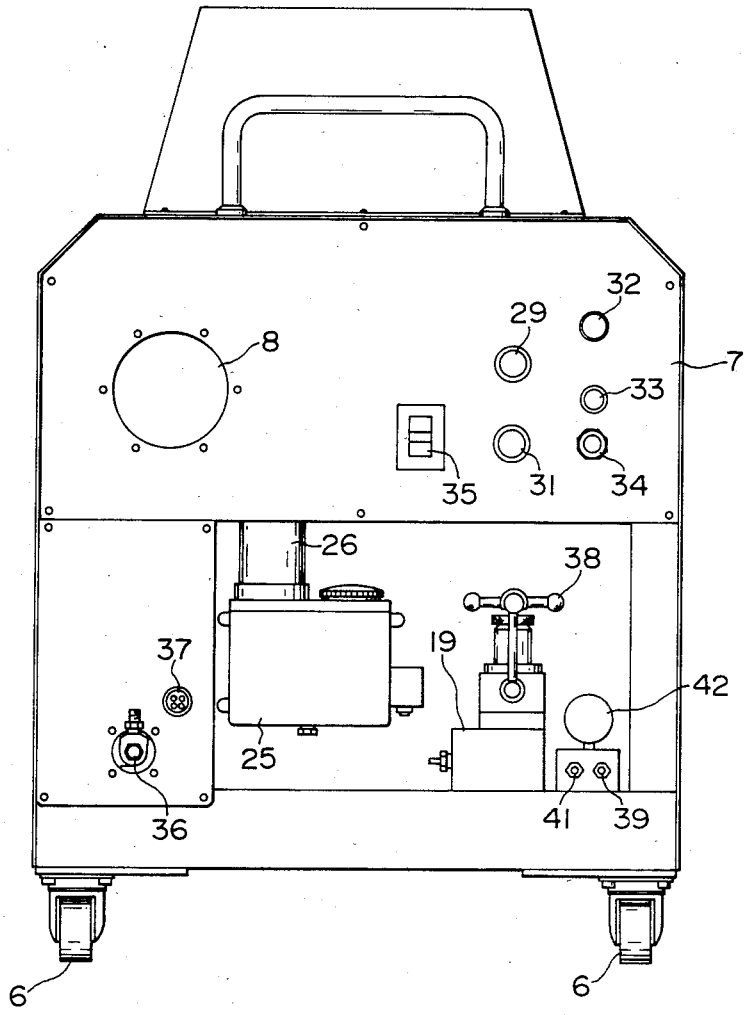
FIG. 4 is a front view of the apparatus shown in FIG. 2.

FIG. 2 through FIG. 4 illustrates typical layouts of the parts of the ultrahigh pressure water apparatus according to the present invention, with the covers removed to show the interiors thereof to better advantage. The pipes distributed to the relevant parts are omitted from the diagrams. Casters 6 are attached to the underside of a base plate 5 to facilitate the transportation of the apparatus. A panel 7 covers the upper half of the front side of the apparatus. On the panel 7, a pressure gauge 8 indicating the pressure of the jet of water projected through the nozzle is fixed in one half portion. In the other half portion of the panel 7, there are fixed a starter button 29, a stop button 31, an operation display lamp 32, an alarm lamp 33 serving to warn of a shortage of supply of lubricating oil, an alarm buzzer 34 serving to warn of reverse rotation of the motor, and a motor overcurrent breaker 35. Below the panel 7, there are fixed an ultrahigh pressure water outlet 36, a connector 37 to a power source for nozzle rotation, the oil tank 25, the pump 26, and the relief valve 19. The relief valve 19 is provided with a pressure regulating handle 38. By suitable control of the pressure regulating handle 38, the aperture of the valve 19 is adjusted and the pressure of the projected water is fixed. In the lower portion of the front side of the apparatus, there are disposed a water feed inlet pipe 39 communicating with the water inlet pipe 11 and a water drain outlet 41 serving to drain the part of the water spent in the relief valve 19. The pressure of the water received in the water feed inlet 39 is measured by a feed water pressure gauge 42.

As illustrated in FIG. 2 and FIG. 3, the ultrahigh pressure pump 16 and a motor 43 for driving the pump are sequentially disposed on the base plate 5 behind the panel 7. The motor 43 may be an induction motor 3-phase 50 Hz rated for 1,440 rpm, for example. The motor 43 is provided on the rotary shaft thereof with a toothed wheel 44 and the ultrahigh pressure pump 16 is provided on the drive shaft thereof with a toothed wheel 45. A chain 46 is passed around these toothed wheels 44, 45, so that the rotation of the motor 43 may be transmitted to the pump 16. As illustrated in FIG. 3, the backup pump 12 is disposed on the water feed inlet 39 side of the ultrahigh pressure pump 16 and the accumulator 22 is disposed on the high pressure outlet 36 side of the ultrahigh pressure pump 16 respectively. The filter 13 is disposed beside the motor 43. A terminal box 47 for the motor 43 is attached to the top of the motor 43.

Figure 5:
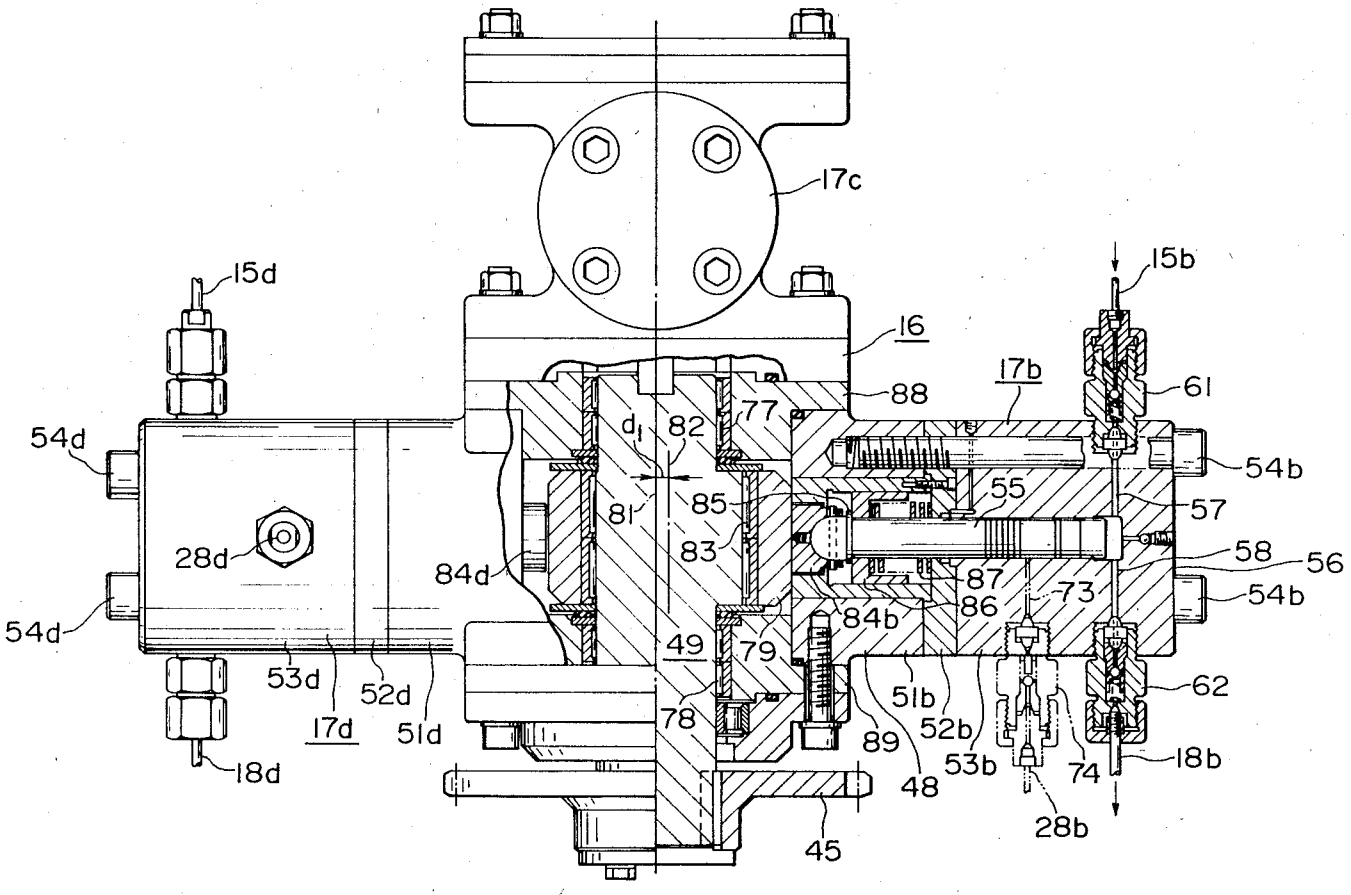
FIG. 5 is a partially sectioned front view of a typical ultrahigh pressure pump 16.
Figure 5A:
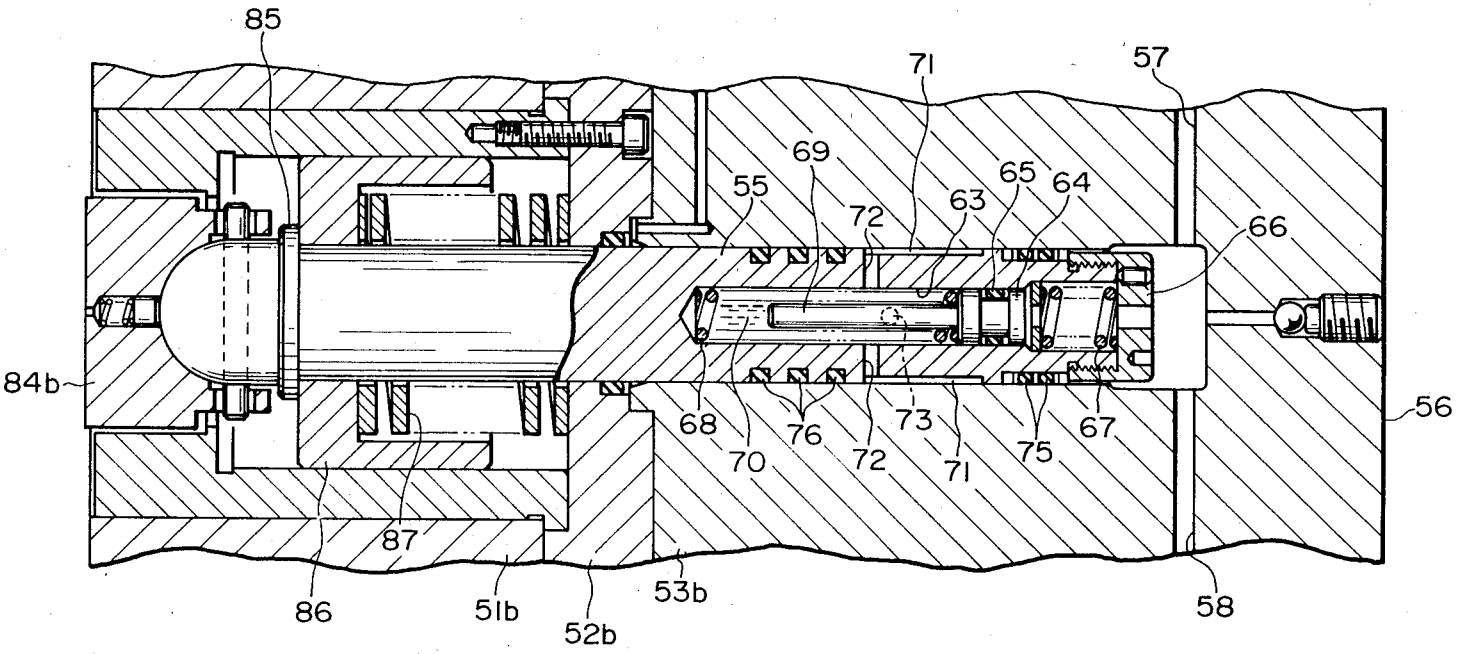
FIG. 5A is an enlarged view of a pump 17*b* in FIG. 5.

The ultrahigh pressure pump 16 is constructed as illustrated in FIGS. 5 and 5A. A drive shaft 49 is inserted into a tubular main body 48. Tubular protuberances 51*b*, 51*d* are integrally thrust out of the main body 48 in mutually opposite directions. To the leading end surfaces of these tubular protuberances 51*b*, 51*d*, cylinders 53*b*, 53*d* are secured via retainer plates 52*b*, 52*d* with bolts 54*b*, 54*d*, respectively. The interiors of the cylinders 53*b*, 53*d* communicate with the interior of the tubular main body 48 via the retainer plates 52*b*, 52*d*. In this manner, the pump sections 17*b*, 17*d* are fixed on the tubular main body 48. The pump sections 17*a*–17*d* have one identical structure. Thus, the pump construction will be described with respect to the pump section 17*b*.

Inside the cylinder 53*b*, a piston 55 is disposed at the axial position freely movably in the axial direction, namely in the direction perpendicular to the drive shaft 49. Near an end face 56 of the cylinder 53*b*, passages 57, 58 communicating through lateral surfaces with the interior of the cylinder 53*b* are formed in opposed positions. Backflow check valves known popularly as check valves 61, 62 communicating with these passages 57, 58 are fastened to the cylinder 53*b*. To the check valves 61, 62 are respectively connected the water feed pipe 15*b* and the discharge pipe 18*b*. A piston hole 63 is formed in the piston 55 along the axial direction from the end face thereof. Inside the piston hole 63, a free piston 64 is disposed freely movably in the axial direction of the cylinder 53*b*. An O-ring 65 is fitted around the peripheral surface of the free piston 64. To the closed end surface of the piston 55 is fastened a flange 66 to form a rim around the opening of the piston hole 63 and prevent the free piston 64 from being pulled out. A coil spring 67 is interposed between this flange 66 and the free piston 64. A coil spring 68 is interposed between the free piston 64 and the piston hole 63. Inside the coil spring 68, a stopper pin 69 is thrust out of the free piston 64. This stopper pin 69 serves to prevent the free piston 64 from being moved excessively on the tubular main body 48 side. At the position corresponding to the middle portion in the axial direction of the piston hole 63, an annular oil collecting recess 71 is formed on the peripheral surface of the piston 55. The oil collecting recess 71 is connected through a communicating hole 72 to the piston hole 63. At the position at which the piston 55 always communicates with the oil collecting recess 71 in spite of its own reciprocating motion, there is formed a passage 73 opening into the lateral surface of the cylinder 53*b*. A check valve 74 communicating with this passage 73 is attached fast to the cylinder 53*b*. The oil feed pipe 28*b* is connected to the check valve 74. Since the passage 73 which serves to pass the lubricating oil runs actually in a direction perpendicular to the direction in which the passages 57, 58 are extended, this passage 73 should not appear in the diagram, but it is indicated by broken lines for convenience. The oil collecting recess 71 and the piston hole 63 are filled with the lubricating oil 70. At the position between the flange 66 and the oil collecting recess 71, O-rings 75 are fitted around the peripheral surface of the piston 55. On the tubular main body 48 side of the oil collecting recess 71 O-rings 76 are fitted around the peripheral surface of the piston 55.

As the piston 55 is drawn in the direction departing from the end face 56 and moved toward the left with respect to the diagram, water from the feed water pipe 15*b* is drawn via the check valve 61 into the interior of the cylinder 53*b*. As the piston is pressed and moved to the right, the water in the cylinder 53*b* has its pressure increased to ultrahigh pressure and is discharged via the check valve 62 into the discharge water pipe 18*b*. At that time, the water in the cylinder 53*b* has its pressure increased to ultrahigh pressure. Consequently, the free piston 64 is moved deeper in the piston hole 63 so as to balance the pressure of the lubricating oil 70 and the pressure of water. Thus, the O-rings 65, 75 which have high sealing property despite its insufficient mechanical strength are enables to retain the seal safely. While the piston 55 is retracted and the water is withdrawn, the pressure of the water within the cylinder 53*b* is notably lowered. In this case, the free piston 64 is moved inside the piston hole 63 in the direction of being pulled out of the piston hole 63, so as to balance the pressures on the opposite sides of the O-rings 65, 75. Thus, the seal by the O-rings is retained intact. Besides, the coil spring 67 prevents the free piston 64 from violently colliding against the flange 66. The position of the free piston 64 during the absence of pressure application is determined by the coil springs 67, 68. The free piston 64 is moved as described above. The free piston 64 is small. The movement of this free piston 64 keeps the inner wall of the piston hole 63 wetted with the lubricating oil 70 to ensure ample lubrication. The free piston 64, therefore, is allowed to move smoothly in quick response to the change of pressure balance between the water and the lubricating oil. Thus, the balance of pressure between the water and the lubricating oil is retained safely and the seal is also retained in good condition. Instead of the free piston 64 it would be possible to decrease the outside diameter of the piston 55 in the middle portion thereof and dispose an annular type free piston around the constricted portion of the piston 55. In this case, however, the constricted portion would suffer from insufficient mechanical strength. The overall size reduction has its limit. Also, the constricted portion would not withstand very high water pressure. In the embodiment of this invention illustrated in FIGS. 5 and 5A, however, since the free piston 64 is disposed inside the piston hole 63 the piston 55 has ample mechanical strength to permit size reduction and to withstand high water pressure. Since the reciprocation of the piston 55 keeps the inner wall of the cylinder 53*b* wetted with the lubricating oil, the piston O-rings 76 are minimally susceptible of wear.

Now, the driving of the piston 35 will be described. Flanges 88, 89 are fastened to the opposite ends in the axial direction of the tubular main body 48. The drive shaft 49 is pierced through the flanges 88, 89 and bearings 77, 78 are interposed respectively between the flanges 88, 89 and the drive shaft 49. The toothed wheel 45 is fastened to the top of the end portion of the drive shaft 49 protruding from the flange 89. Inside the tubular main body 48, a tubular collar 79 is rotatably inserted around the drive shaft 49. The center 81 of the drive shaft 49 deviates by $d_1$ (6 mm, for example,) from the center 82 of the driving portion of the tubular collar 79. A bearing 83 is interposed between the inner wall of the tubular collar 79 and the drive shaft 49. An end portion of the piston 55 on the side of the tubular collar 79 is connected with a drive piece 84b having an end face abutting against the outer peripheral surface of the tubular collar 79. A flange 85 is integrally formed on the peripheral surface at the leading end of the piston 55 on the drive piece 84*b* side. A movable ring 86 is inserted on the piston 55 and a coil spring 87 is interposed between the movable ring 86 and the retainer plate 52*b*. By the coil spring 87, the piston 55 is pressed toward the drive shaft 49 side.

When the center 82 of the drive unit is positioned, by the rotation of the drive shaft 49, on the pump section 17*b* side relative to the center 81 as illustrated in the diagram, the piston 55 of the pump section 17*b* is driven to the greatest extent into the cylinder 53*b* and the piston of the pump section 17d is conversely pulled out to the greatest extent from the cylinder 53*d*. When the center 82 is shifted toward the pump section 17*d* side relative to the center 81, the piston 55 of the pump section 17*b* is drawn out to the greatest extent from the cylinder 53*b* and the piston of the pump section 17*d* driven to the greatest extent into the cylinder 53*d*.

The pump sections 17*a*, 17*c* similar in construction to the pump sections 17*b*, 17*d* are disposed on the portion of the drive shaft 49 protruding from the flange 88. The direction in which the pump sections 17*a*, 17*c* are extended perpendicularly intersects the direction in which the pump sections 17*b*, 17*d* are extended. The eccentricity of the drive unit inside the tubular collar (not shown) for the pump sections 17*a*, 17*c* is deviated by 90 degrees from the eccentricity of the drive unit inside the tubular collar 79. Through the pump sections 17*a*–17*d*, streams of ultrahigh pressure water deviated from one another by 90 degrees in phase are discharged successively.

Figure 6:
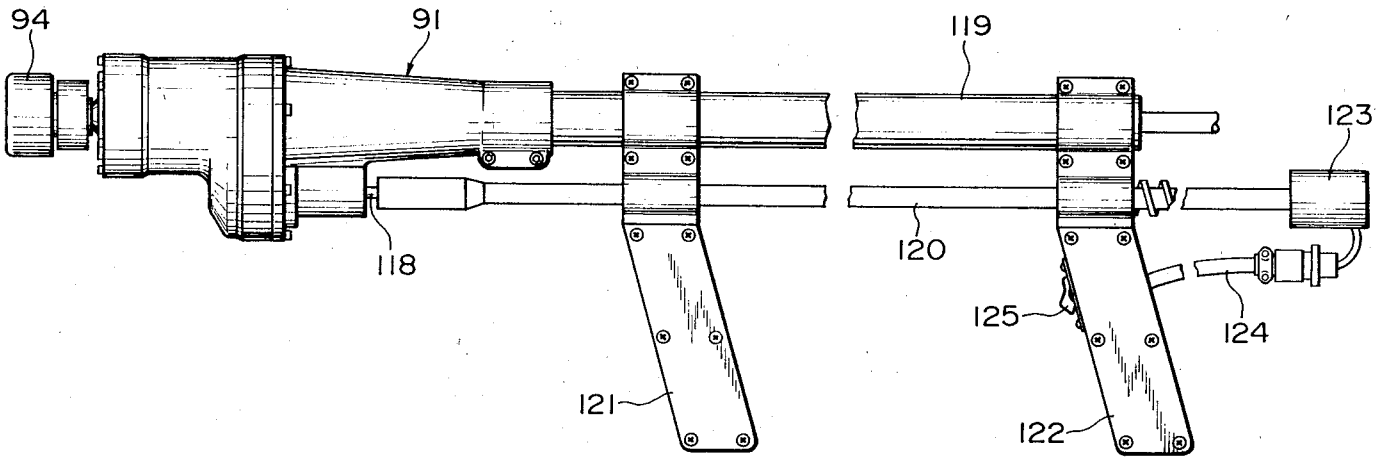
FIG. 6 is a side view illustrating a typical nozzle gun 24.
Figure 6A:
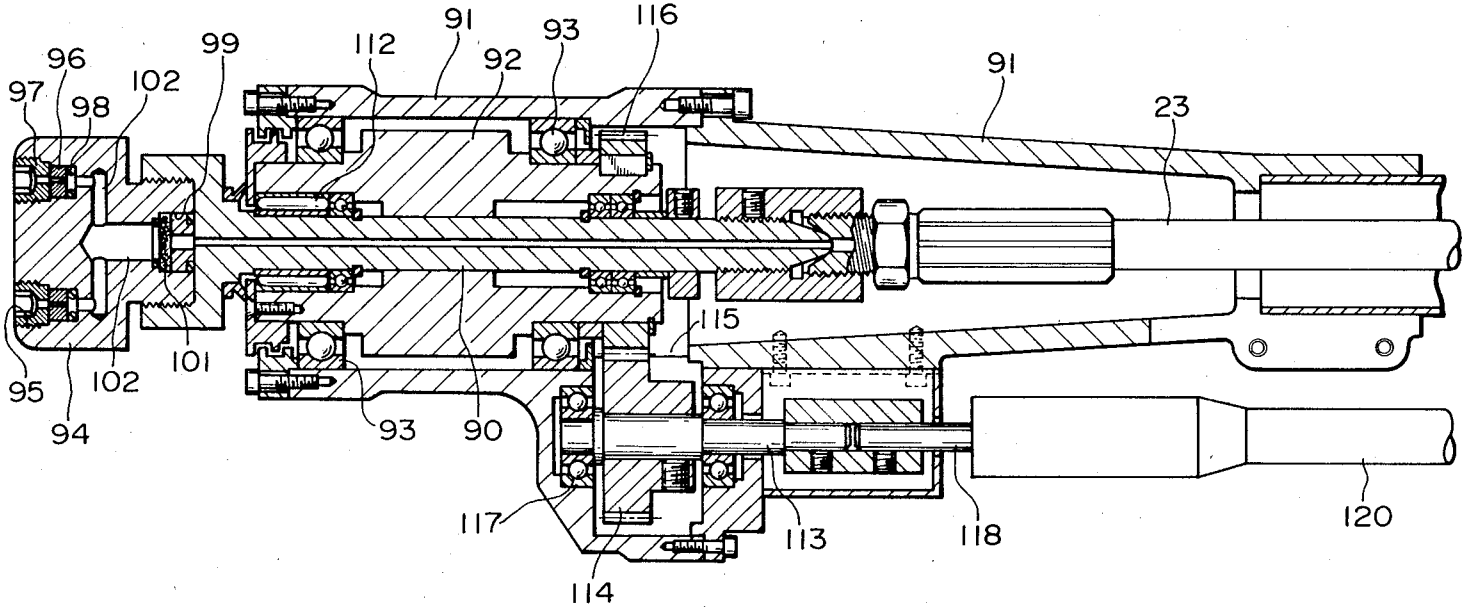
FIG. 6A is an enlarged cross sectional view of the tip of the nozzle gun 24 shown in FIG. 6.

Now, a typical nozzle gun 24 will be described with reference to FIGS. 6 and 6A. Inside a substantially tubular nozzle cover 91, a shaft tube 92 is rotatably supported via a bearing 93. A metal pipe 90 is rotatably inserted into the shaft tube 92. One end of the metal pipe 90 is connected to the high pressure hose 23. A nozzle retainer 94 is fastened to the protruding portion of the other end of the metal pipe 90. A plurality of retaining holes 95 are formed in the end surface of the nozzle retainer 94. Nozzles 96 are embedded one each in these retaining holes 95 and setscrews 97 are driven in to immobilize the nozzles 96 to the nozzle retainer 94. O-rings 98 are disposed one each at the bottoms of the retaining holes 95. A filter holder 99 communicating with the nozzle retainer 94 is formed on the high pressure hose 23 side of the nozzle retainer 94 and a filter 101 for stopping foreign particles is accommodated inside the filter holder 99. A high pressure water manifold 102 communicating with the filter holder 99 is formed in the nozzle retainer 94. The high pressure manifold 102 communicates with the nozzle retaining holes 95. Consequently, the ultrahigh pressure water inside the high pressure hose 23 is passed through the filter 101 and the manifold 102 and projected through the nozzles 96.

Figure 7:
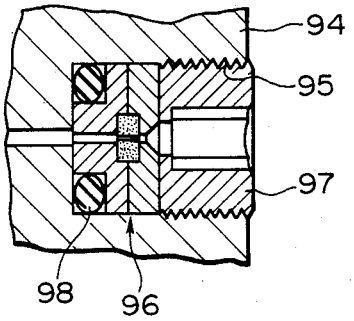
FIG. 7 is an enlarged cross section of a nozzle fixing part.
Figure 8:
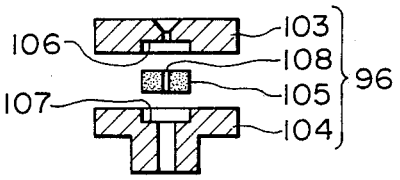
FIG. 8 is a cross section illustrating a nozzle in its disassembled state.

Each nozzle 96 is composed, as illustrated in FIG. 7 and FIG. 8, of a pair of retaining pieces 103, 104 made of a metallic material such as Monel Metal and a nozzle body 105 made of diamond and sandwiched by the retaining pieces 103, 104. In the abutting surfaces of the retaining pieces 103, 104, recesses 106, 107 are formed in an opposing relationship and they permit the nozzle body 105 to be fitted and retained therein. The retaining pieces 103, 104 kept in their mutually adjoining state are fused together. A nozzle orifice 108 is formed in the nozzle body 105. The diameter of this nozzle orifice 108 determines the diameter of the jet of ultrahigh pressure water projected through the orifice. The diameter of the nozzle orifice 108 is fixed at 0.18 mm, for example. An angular hole is formed in the setscrew 97. By inserting a fastening device inside this angular hole, the setscrew 97 can be easily fastened inside the retaining hole 95. By this fastening, the O-ring 98 is pressed against the bottom of the retaining hole 95 so as to prevent otherwise possible leakage of ultrahigh pressure water.

Figure 9:
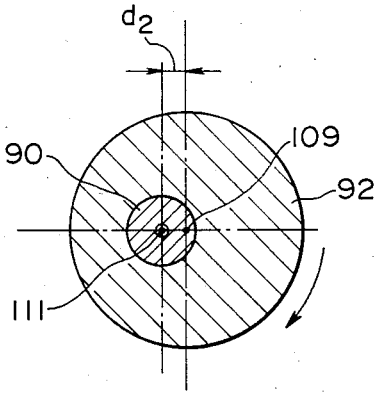
FIG. 9 is a cross section illustrating the condition of eccentricity between a nozzle gun and a shaft tube.

Referring again to FIGS. 6 and 6A, the center 111 of the inner wall of the shaft tube 92 is deviated by $d_2$ (5 mm, for example), relative to the cross-sectional center 109 of the shaft tube 92 (see FIG. 9). A bearing is interposed between the shaft tube 92 and the metal pipe 90. Outside the nozzle cover 91, a drive shaft 113 is disposed substantially in parallel to the high pressure hose 23 (under the nozzle cover 91 as illustrated in the diagram). By the rotation of this drive shaft 113, the shaft tube 92 is rotated. A toothed wheel 114 is fixed on the drive shaft 113 and part of this toothed wheel 114 is allowed to take its position inside the nozzle cover 91 through an opening 115 formed in the nozzle cover 91. A toothed wheel 116 is fixed on the peripheral surface of the shaft tube 92. These toothed wheels 114, 116 are meshed with each other. Part of the nozzle cover 91 is extended to conceal the toothed wheel 114. The drive shaft 113 is pivotally supported by the bearing 117 inside the extended part of the cover 91. The drive shaft 113 is connected to a flexible shaft 118 which is threaded through a flexible sheath 120. The free end of the flexible shaft 118 is connected to the rotary shaft of a motor 123 for the motion of the nozzle disposed close to the main body of the apparatus on which the ultrahigh pressure pump 16 and the motor 43 are disposed. A support pipe 119 is connected to the end of the nozzle cover 91 falling on the opposite side of the nozzle retainer 94. The high pressure pipe 23 is inserted into the suppport pipe 119. The flexible shaft 118 is laid along the support pipe 119. A pair of retainers 121, 122 are fastened to the support pipe 119 and the flexible sheath 120. Into the retainer 122, a power source cord 124 is led. Inside the retainer 122, there is disposed an ON-OFF control switch 125 for a power source line wrapped in the power source cord 124. The power source cord 124 is laid along the flexible sheath 120. The power for driving the motor 123 is derived from the power source connector 36 already described with reference to FIG. 4.

By turning ON or OFF this switch 125, the motor 123 for the operation of the nozzle can be set rotating or stopped. When the motor 123 is set rotating, the flexible shaft 118 is rotated and, as the result, the drive shaft 113 is rotated. The rotation is transmitted via the toothed wheels 114, 116 to the shaft tube 92. Since the center of the inner wall of the shaft tube 92 is deviated relative to the center 109 of the peripheral surface thereof, the high pressure pipe 23 is caused to rotate about the center 109 of the peripheral surface of the shaft tube 92. Consequently, the jet of water projected through the nozzle 98 is rotated in conjunction with the rotation of the high pressure pipe 23. Thus, even when the nozzle gun is directed to one point on a given object, the point at which the beam of water collides with the object describes a circle. When a plurality of nozzles 96 are provided as in the present embodiment, since all the jets of water describe circles on the object, the ultrahigh pressure jets of water can be dashed uniformly within a fixed range of area against the object. Thus, the diameter of the jet of water may be decreased. This means that the amount of water projected per unit time can be decreased and the nozzle can be light enough to be manually handled easily without any danger. It can be used to spurt the ultrahigh pressure water at portions of complicated objects which can not easily be treated with the conventional ultrahigh pressure water apparatus. Quite satisfactory surface treatment can be given to various objects by an apparatus in which six nozzles 96 having an orifice 108 diameter of 0.18 mm are circumferentially spaced on a circle 27 mm in diameter and the centers 109, 111 are deviated by 5 mm. The jets of water projected through these nozzles have a pressure of 2,000 kg/cm$^2$.

Figure 11:
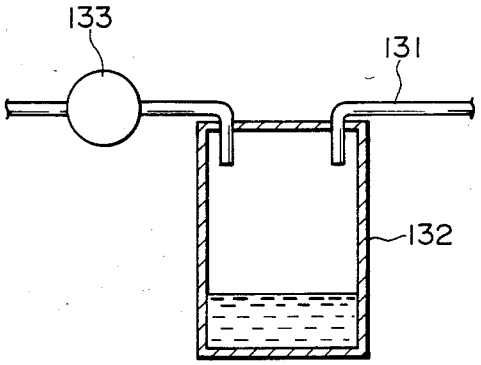
FIG. 11 is a cross section illustrating a typical suction means for evacuating the interior of the collector.
Figure 10:
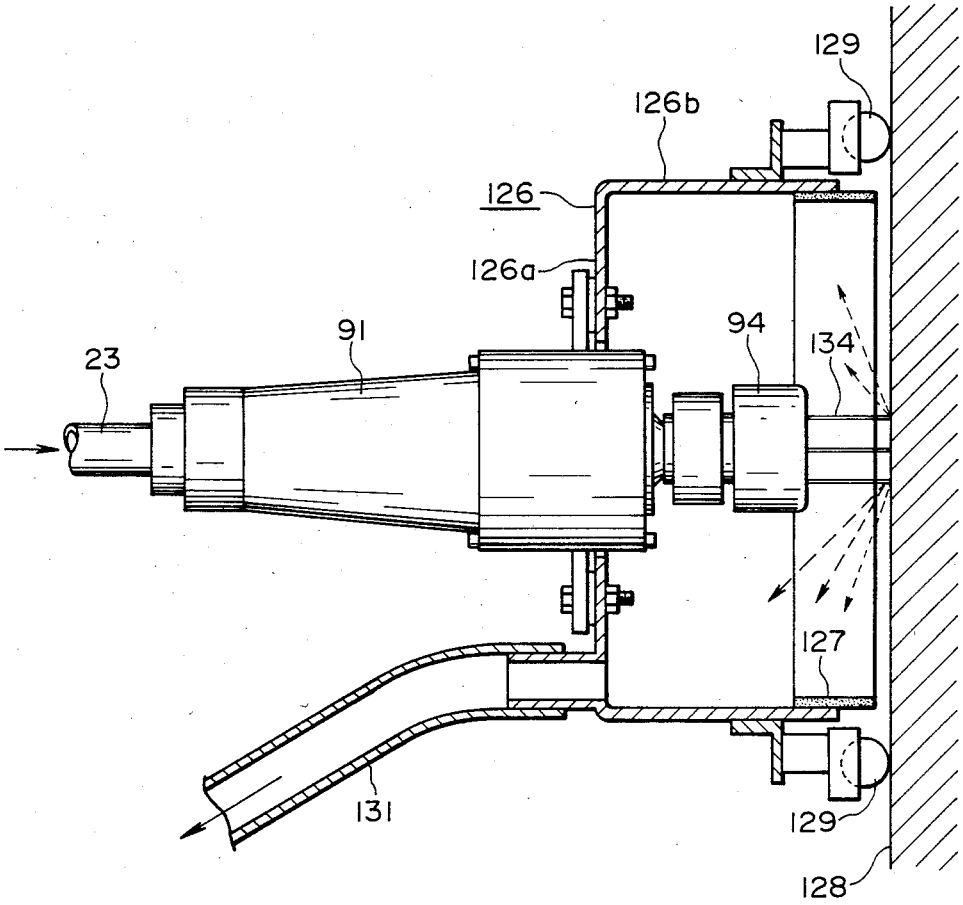
FIG. 10 is a cross section illustrating a collector attached to the nozzle gun.

The ultrahigh pressure water apparatus may be designed so as to collect the portion of water rebounded from the object. As illustrated in FIG. 10, for example, a collector 126 is disposed to enclose the nozzle retainer 94 at the end part of the nozzle cover 91. The collector 126 has its opening in the direction in which the jet of water is projected through the nozzle retainer 94. A circular plate **126*a* of the collector 126 centering around the nozzle cover 91 is fastened to the nozzle cover 91 and a tubular part 126*b* is itegrally extended from the peripheral edge of the circular plate 126*a* in parallel to the nozzle retainer 94. Optionally, around the periphery at the open end of the tubular part 126*b*, an elastic part 127 made of rubber is thrust out in the direction of the object 128. Three casters 129 are fixed on the periphery of the tubular part 126*b*. The casters 129 are rolled on the object 128 to freely move the nozzle retainer 94 along the surface of the object 128 while keeping the distance between the nozzle retainer 94 and the surface of the object 128 constant. To the tubular part 126***b* of the collector 126 is connected a drain hose 131 communicating with the interior of the collector 126. The drain hose 131 is connected, as illustrated in FIG. 11, to the interior of a tank 132. The air inside the tank 132 is withdrawn by a vacuum pump 133.

The air entrapped in the space enclosed by the collector 126 and the object 128 is withdrawn by the vacuum pump 133 into the drain hose 131. Jets of water 134 projected from the nozzles, therefore, are dashed against the object 128 and the portion of water rebounded by the object is drawn into the drain hose 131 together with the air and collected in the recovery tank 132. Since the rebounded water is collected as described above, the site of operation of the generator is prevented from being soaked with the rebounded water. When a large object such as, for example, a railroad coach is desired to be stripped of a coating thereon, the environment of the cleaning work will not be jeopardized by the use of the apparatus in question, although the duration of work may be lengthened and the volume of water used may be increased.

Optionally, the water which is projected in the form of jets of ultrahigh pressure water may contain therein such chemicals as detergent and rustproofing agent in advance. Not only fresh water but also sea water may be used for the cleaning work by the use of the apparatus of this invention. The drive source for the operation of the ultrahigh pressure pump 16 need not be limited to a motor. An engine may be adopted instead.

I claim:

1. An ultrahigh pressure water apparatus for treating the surface of an object with high pressure jets of water, comrising an ultrahigh pressure pump, means for driving said pump, said pump being operative to receive feed water and discharge ultrahigh pressure water, and a nozzle gun for receiving the ultrahigh pressure water supplied from said ultrahigh pressure pump and for projecting said ultrahigh pressure water in the form of jets onto the surface of an object to be treated by such jets, said nozzle gun comprising:

a tubular nozzle cover;

a cylindrical shaft mounted for rotation within said nozzle cover, said cylindrical shaft having a retaining hole extending therethrough at a position which is eccentric to the center axis of said cylindrical shaft;

a metal tube retained in and extending through said retaining hole in said cylindrical shaft, said metal tube being rotatable relative to said shaft and having a high pressure through hole therein;

a high pressure hose connected at one end thereof to one end of said metal tube and extending therefrom out of said nozzle cover, the other end of said hose being connected to said ultrahigh pressure pump for transmitting said ultrahigh pressure water from said pump through said hose to said metal tube;

a nozzle retainer detachably attached to the other end of said metal tube coaxially therewith, said nozzle retainer having a filter receiving recess formed in a first end face thereof on the side of said retainer to be attached to said other end of said metal tube, said recess communicating with said high pressure through hole of said metal tube, a filter mounted in said filter receiving recess, a plurality of nozzle receiving holes formed in a second end face of said nozzle retainer opposite to said first end face, the interior of said nozzle retainer between said first and second end faces being formed to define a plurality of water paths located respectively between said filter receiving recess and said nozzle receiving holes, and a plurality of nozzles disposed respectively in said nozzle receiving holes for projecting ultrahigh pressure water jets from said nozzle gun;

a drive shaft rotatably mounted on said nozzle cover adjacent said cylindrical shaft;

means disposed in engagement with said drive shaft and said cylindrical shaft for transmitting rotation of said drive shaft to the cylindrical shaft thereby to cause rotation of said metal tube and nozzle retainer;

a collector cover comprising a cylindrical tubular body mounted on said nozzle cover to surround and partially enclose said nozzle retainer, said tubular body having an opening at the end thereof which faces in the direction in which said ultrahigh pressure water jets are projected from said nozzle gun, the other end of said tubular body being closed by an end plate;

a plurality of casters mounted on said collector cover around the open end of said tubular body and extending forwardly of the said open end of said tubular body so that, when said nozzle gun is urged against the surface of an object to be treated, said casters engage said surface and maintain at a constant value the distance between said nozzles and the object surface while said nozzle gun is moved across the object surface; and a vacuum pump and drain hose connected to said collector cover to reduce the ambient pressure within said collector cover, and to remove, through said drain hose, water which rebounds from said object surface to the interior of said collector cover.

2. The ultrahigh pressure water apparatus of claim 1 wherein said drive shaft is connected to one end of a flexible shaft, said flexible shaft being connected to the rotary shaft of a motor which is disposed near said ultrahigh pressure pump at a location remote from said nozzle gun, a power source cord extending from said motor to said nozzle gun, and a switch on said nozzle gun connected to said power source cord and adapted to start or stop said motor.

3. The ultrahigh pressure water apparatus of claim 1 wherein each of said nozzles comprises a diamond body having a fine through hole formed therein, and a pair of metal retainers disposed in adjoining relation to one another, each of said retainers having a center through hole therein, at least one of said metal retainers defining a recess therein which is coaxial with said center through hole and which faces the other of said retainers to define an interior cavity between said retainers in which said diamond body is disposed with its fine through hole in alignment with the center through holes of said retainers, the adjoining surfaces of said pair of metal retainers being fused together.

4. The ultrahigh pressure water apparatus of claim 3 wherein said nozzles are removable from said nozzle receiving holes, and set screws in thread engagement with said nozzle retainer adjacent each of said nozzle receiving holes for fastening said nozzles in place within said nozzle receiving holes.

* * * * *